US010107055B2

(12) United States Patent
Hetz et al.

(10) Patent No.: US 10,107,055 B2
(45) Date of Patent: Oct. 23, 2018

(54) CORE CATCHER

(71) Applicant: Baker Hughes Incorporated, Houston, TX (US)

(72) Inventors: Avigdor Hetz, Houston, TX (US); James Cernosek, Missouri City, TX (US)

(73) Assignee: BAKER HUGHES, A GE COMPANY, LLC

( * ) Notice: Subject to any disclaimer, the term of this patent is extended or adjusted under 35 U.S.C. 154(b) by 180 days.

(21) Appl. No.: 15/254,608

(22) Filed: Sep. 1, 2016

(65) Prior Publication Data

US 2018/0058164 A1 Mar. 1, 2018

(51) Int. Cl.
*E21B 25/10* (2006.01)
*E21B 49/06* (2006.01)
*E21B 10/02* (2006.01)

(52) U.S. Cl.
CPC ..... *E21B 25/10* (2013.01); *E21B 10/02* (2013.01)

(58) Field of Classification Search
CPC ..... E21B 25/10; E21B 25/14; E21B 25/00; E21B 25/12; E21B 49/06
See application file for complete search history.

(56) References Cited

U.S. PATENT DOCUMENTS 331,319 A * 12/1885 Parker ..... E21B 31/18 294/86.26
648,920 A 5/1900 Bullock
1,775,920 A 9/1930 Wellensiek
1,791,256 A 2/1931 Wellensiek
1,859,950 A * 5/1932 Zublin ..... E21B 25/10 175/249
2,028,579 A * 1/1936 Wright ..... E21B 25/14 175/254
2,038,791 A * 4/1936 Howard ..... E21B 25/00 175/239
2,054,277 A * 9/1936 Wright ..... E21B 10/02 175/254
2,103,611 A 12/1937 Catland et al.
2,161,582 A * 6/1939 Hoffoss ..... E21B 25/14 175/254
2,182,374 A * 12/1939 Dumble ..... E21B 4/10 166/104
2,306,369 A * 12/1942 Anderson ..... E21B 25/10 175/249
2,329,405 A * 9/1943 Mann ..... E21B 25/10 175/250
2,490,512 A 12/1949 Deely
2,553,032 A 5/1951 Bentson
2,850,265 A 9/1958 Cruthers
3,383,131 A * 5/1968 Rosfelder ..... E21B 25/06 175/240
4,142,594 A 3/1979 Thompson et al.
(Continued)

FOREIGN PATENT DOCUMENTS

CN 202031513 11/2011

OTHER PUBLICATIONS

URAL BMT, Core Drilling Bits/Core Catchers, retrieved on Apr. 11, 2016 from www.uralbmt.com/1011/.

*Primary Examiner* — Kipp C Wallace
(74) *Attorney, Agent, or Firm* — Shawn Hunter

(57) ABSTRACT

A rotary coring bit and rotary coring tool which includes a core catching torsion spring.

19 Claims, 5 Drawing Sheets

(56) References Cited

U.S. PATENT DOCUMENTS

| | | | | |
|---|---|---|---|---|
| 4,466,495 | A * | 8/1984 | Jageler | E21B 49/06<br>175/59 |
| 4,606,416 | A | 8/1986 | Knighton et al. | |
| 4,643,265 | A | 2/1987 | Aiura et al. | |
| 5,445,229 | A | 8/1995 | Delima | |
| 6,305,482 | B1 | 10/2001 | Aumann et al. | |

* cited by examiner

FIG. 2
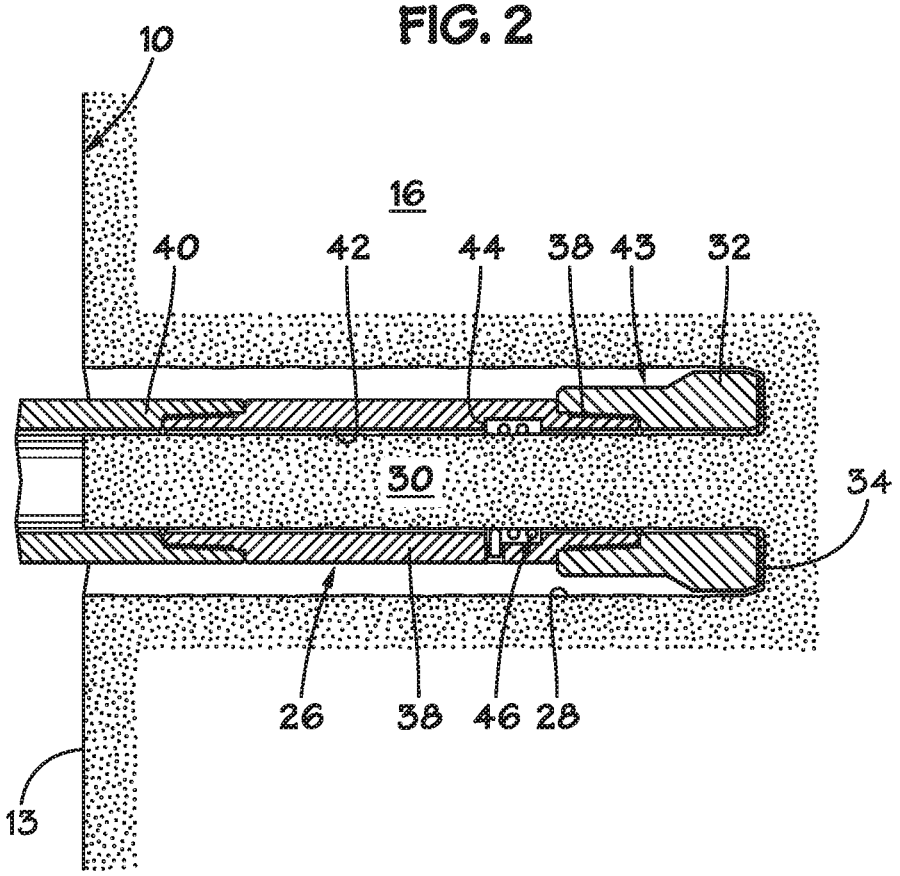
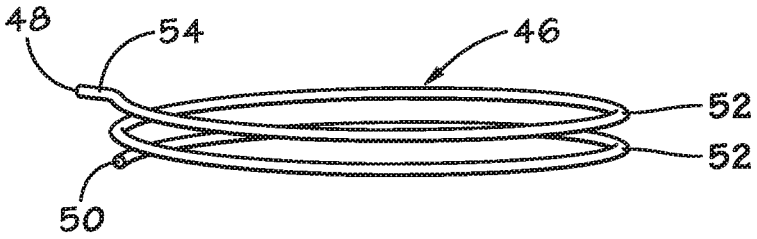
FIG. 3

CORE CATCHER

BACKGROUND OF THE INVENTION

1. Field of the Invention

The invention relates generally to wellbore coring arrangements which include a rotary coring bit.

2. Description of the Related Art

Coring devices are known for obtaining core samples from the sidewall of a wellbore. The wellbore is typically uncased but may, on occasion, be a cased wellbore. Often, a rotary coring bit is used to cut a circular opening in the sidewall. The volume of sidewall which lies within the circular opening is then broken away from the formation to form a core. The core is then transported to surface where it can be analyzed.

SUMMARY OF THE INVENTION

The invention provides a coring arrangement which includes a core catcher which resides within a coring bit and which is used to securely hold the core within the coring bit. The inventors have recognized that, during a coring job, it is important to securely hold the core after cutting and breaking it off from the formation wall and retain it within the bit so that the core will not slide out and either get lost or get stuck within the coring mechanism.

In a described embodiment, a coring bit includes a core catcher in the form of a core catching torsion spring which resides within the coring bit's core chamber. Preferably, the torsion spring resides within an interior spring groove within the core chamber. Preferably also, a first spring end of the core catching torsion spring is rotationally fixed to the coring bit while the second spring end of the torsional spring is unsecured to the coring bit.

The core catching torsion spring is expanded radially as the core sample is being drilled. Friction between the sidewall of the wellbore and the core catching torsion spring will radially expand the core catching torsion spring. The second spring end of the torsion spring will contact the core sample during drilling and be urged back toward the first spring end along the body of the torsion spring, thereby radially expanding the torsion spring. As coring continues, the radial interior portions of the core catching torsion spring are maintained largely or completely out of contact with the core, resulting is a significant reduction in friction forces. When the core catching torsion spring is radially enlarged due to rotation and friction, the normal forces between the core and the spring are reduced, leading to reduced spring wear and increased lifetime for the core catching torsion spring. When drilling stops, the core catching torsion spring will contract radially to capture the core within the coring bit.

The core catching torsion spring of the present invention also provides an improved technique for detaching and removing a core sample from the wellbore. In addition to applying a lateral or angular force to the attached core sample to break it away from the formation, the core catching torsion spring will apply a tensional force to the core sample to help separate the core sample from the formation. This improved technique would be particularly useful in situations where the formation has a low unconfined compressive strength.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein:

FIG. 2 is a side, cross-sectional view illustrating exemplary operation of a coring tool to obtain a core sample from the wellbore.

FIG. 3 illustrates an exemplary torsion spring apart from other components of the coring bit.

DETAILED DESCRIPTION OF THE PREFERRED EMBODIMENTS

Figure 1:
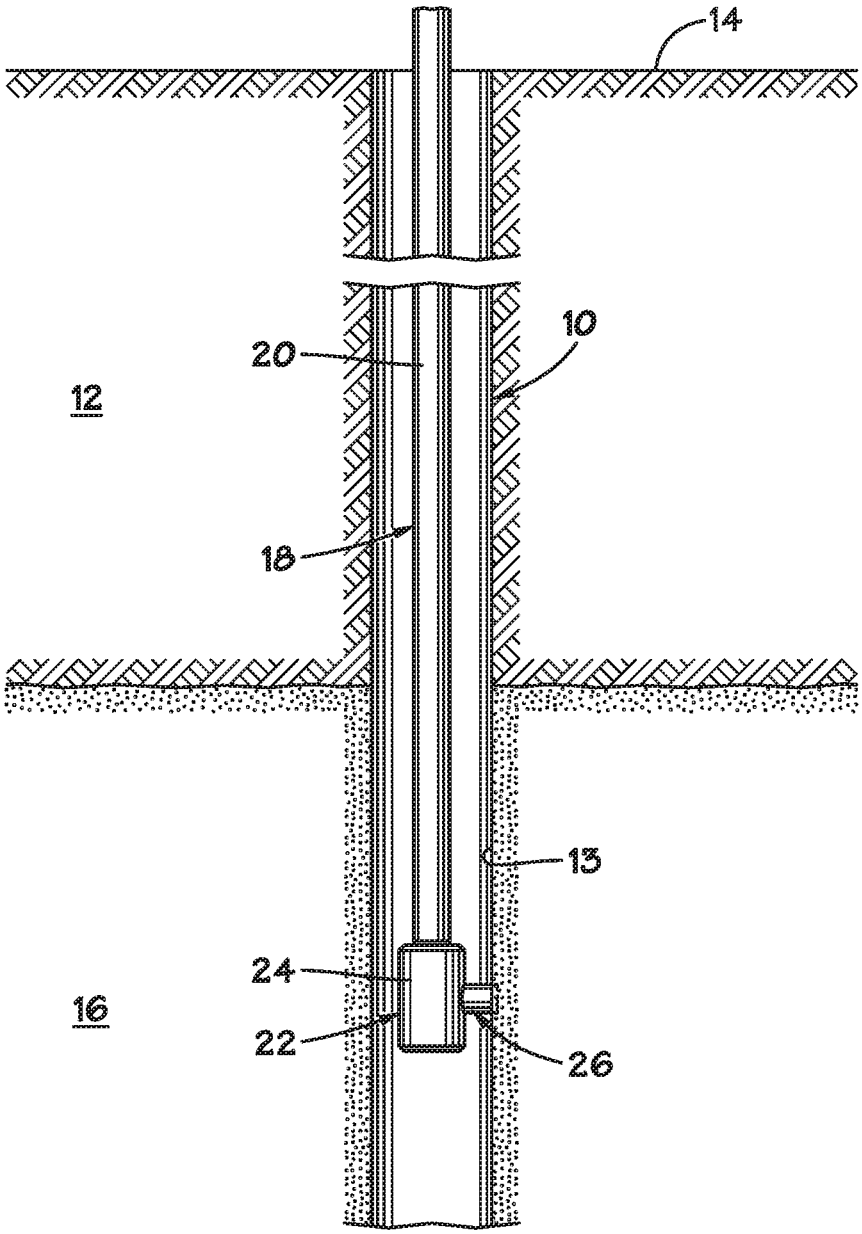
FIG. 1 is a side, cross-sectional view of an exemplary wellbore which contains a rotary coring tool for obtaining a core sample from the wellbore.

FIG. 1 depicts an exemplary wellbore 10 which has been drilled through the earth 12 from the surface 14 to a subterranean formation 16 from which it is desired to obtain a core sample. In the depicted embodiment, the wellbore 10 is not lined with casing and presents a sidewall 13. It is noted, however, that the invention is not limited to use in uncased wellbores. A coring work string 18 has been run into the wellbore 10 from the surface 14. The coring work string 18 includes a running string 20 and a rotary coring tool 22. In certain embodiments, the running string 20 is coiled tubing. However, the running string 20 might also be made up of conventional tubular sections which are interconnected in an end-to-end fashion or be wireline.

The rotary coring tool 22 includes a rotary engine 24 which rotates a coring bit 26 and cause it to cut into the formation 16 surrounding the wellbore 10. Suitable coring arrangements for use as the coring tool 22 include the MaxCOR and PowerCOR sidewall coring tools which are available commercially from Baker Hughes of Houston, Tex.

FIG. 2 illustrates an exemplary operation to obtain a core sample from the formation 16 radially surrounding the wellbore 10. The coring tool 22 has rotated the coring bit 26 to form a circular opening 28 in the formation 16. After the circular opening 28 is cut to a desired depth, the volume of formation that is located radially within the circular opening 28 is broken free from the formation 16 to form a core sample 30.

An exemplary coring bit 26 is depicted in greater detail in FIGS. 2-3. The coring bit 26 includes a distal end ring 32 having a cutting edge 34 which is suitable for cutting rock as the coring bit 26 is rotated. A bit shaft 36 is secured to the end ring 32, preferably by threaded connection 38. The bit shaft 36 may also be affixed to a shaft extension 40. A core chamber 42 is defined radially within the end ring 32 and bit shaft 36. The core chamber 42 may extend slightly into the shaft extension 40, depending upon the depth of the circular opening 28. The distal end ring 32 and the bit shaft 36 collectively form a rotary coring bit body 43. It is noted that, while the rotary coring bit body 43 is depicted as being made up of two separate components 32, 36 which are secured together by threaded connection 38, it could as easily be of unitary design.

A spring groove 44 is preferably formed within the core chamber 42 of the rotary coring bit body 43. Preferably, the spring groove 44 is formed within the bit shaft 36. The spring groove 44 is a radial enlargement which is shaped and sized to retain a torsion spring therein. A core catching torsion spring 46 resides within the core chamber 42 and preferably within the spring groove 44.

An exemplary core catching torsion spring 46 is illustrated in FIG. 3. Core catching torsion spring 46 is a helical spring which presents a first spring end 48 and a second spring end 50. Preferably, the core catching torsion spring 46 has from one to fifteen helical wraps 52. More preferably, there are from two to three wraps 52. Three wraps 52 have been selected based on a balance of the core diameter and axial and compressional force adjustments. In preferred embodiments, the core catching torsion spring 46 is formed of metal. One suitable metal for use in forming the core catching torsion spring 46 is 302 stainless steel. However, other metals or materials could also be used. It is also noted that, while the core catching torsion spring 46 is depicted as having a circular cross-section, other cross-sectional shapes, such as oval, square, triangular and so forth, could also be used. Preferably, the core catching torsion spring 46 has a shape memory characteristic which biases the core catching torsion spring 46 toward a radially contracted position. The first spring end 48 includes an outwardly projecting tang 54 which is angled away from the axis of the spring 46. Preferably the angle of bend for the tang 54 is about 90 degrees. The tang 54 is shaped and sized to reside within a complimentary opening in the bit shaft 36 of the coring bit 26, thereby securing the first spring end 48 to the coring bit 26 while the second spring end 50 is not secured to the coring bit 26.

Figure 4:
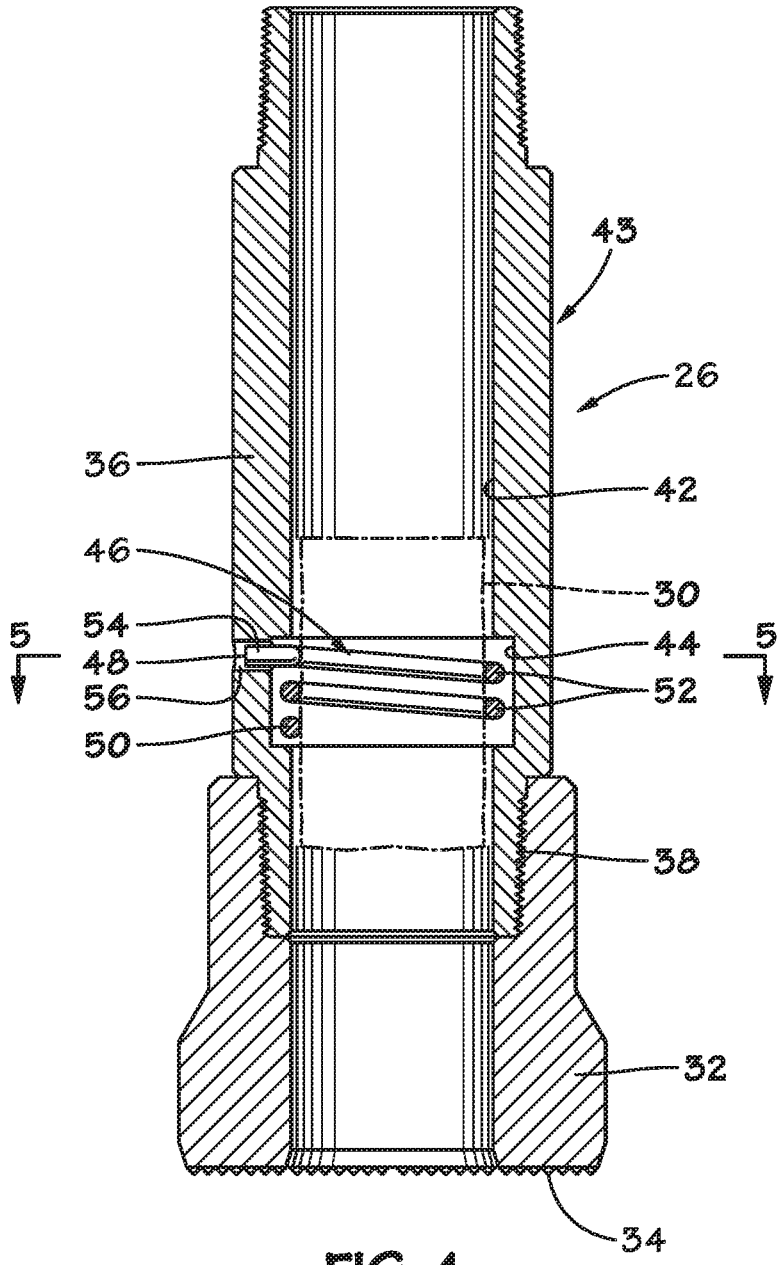
FIG. 4 is a side, cross-sectional view of a coring bit containing an exemplary core catcher constructed in accordance with the present invention.
Figure 5:
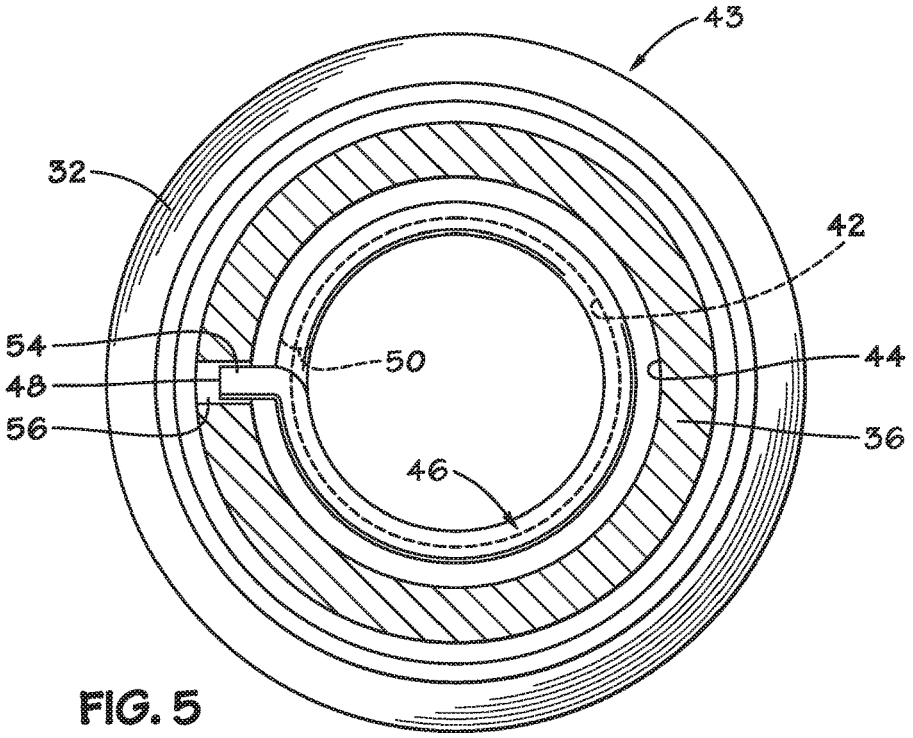
FIG. 5 is an axial cross-sectional view of the coring bit taken along lines 5-5 in FIG. 4.
Figure 6:
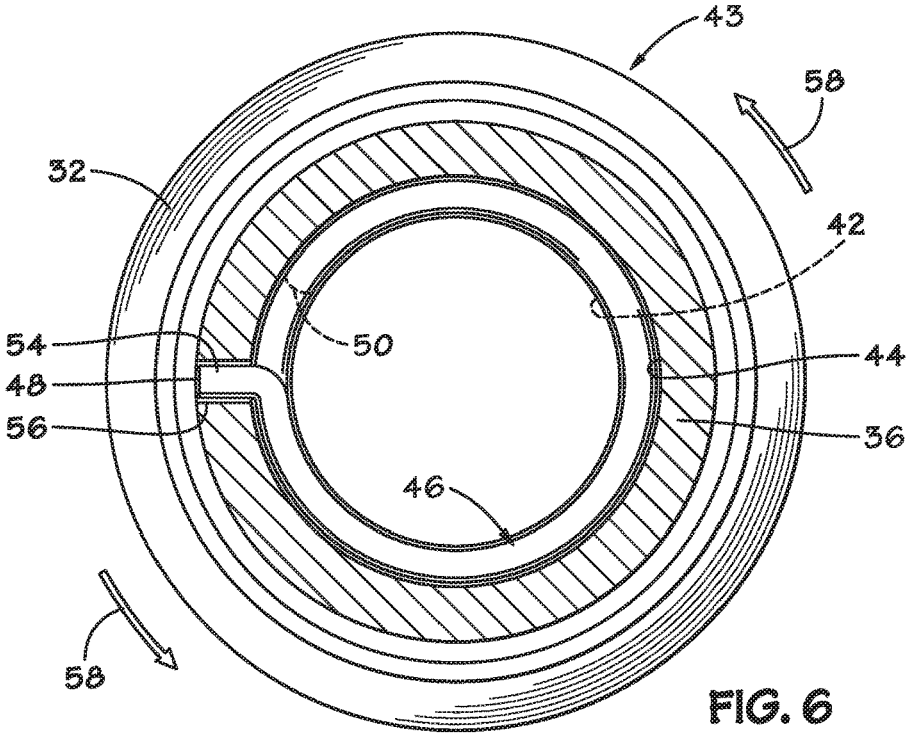
FIG. 6 is an axial cross-sectional view of the coring bit now during rotation of the bit for coring.
Figure 7:
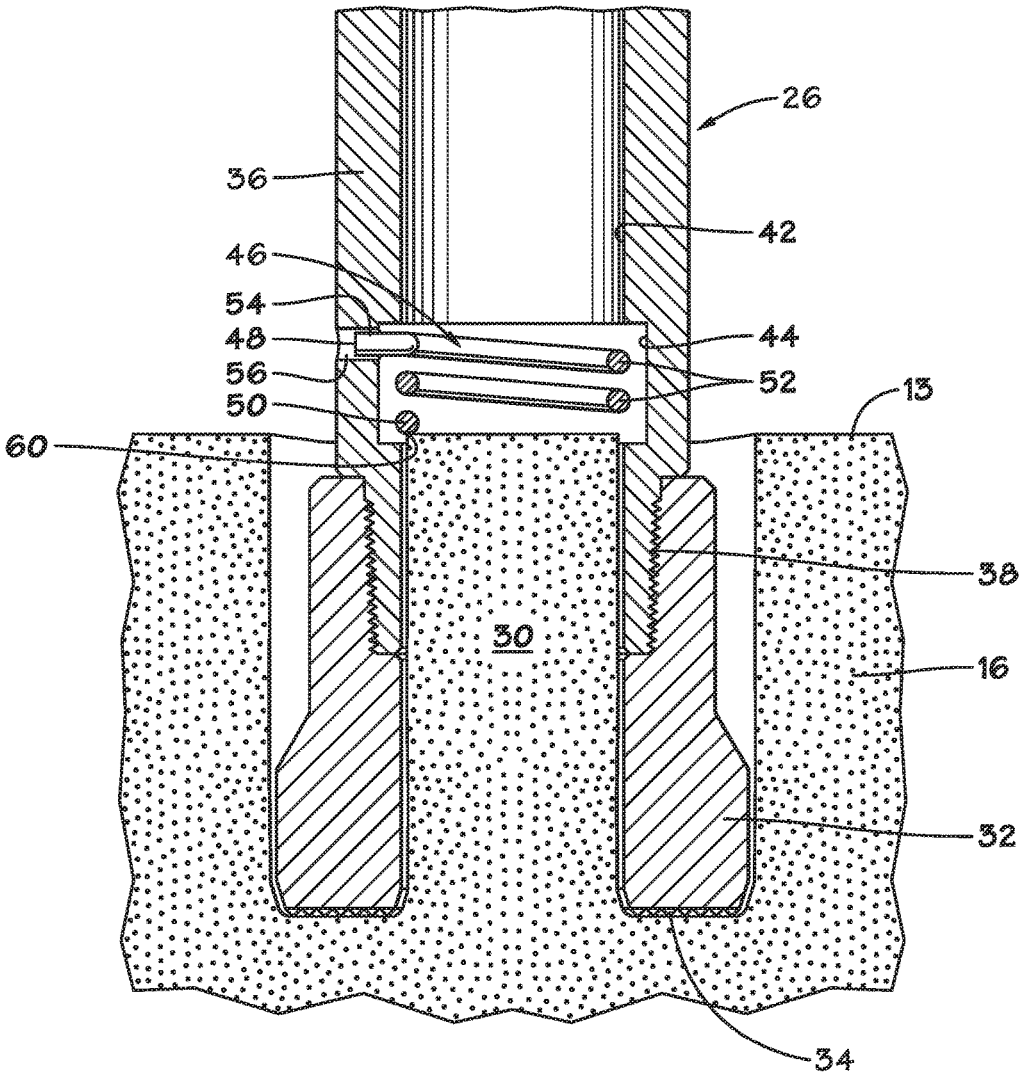
FIG. 7 is a side, cross-sectional view of the coring bit as it bores into a wellbore sidewall and radially expanding the core catching torsion spring.

FIGS. 4-6 illustrate portions of the exemplary coring bit 26 is greater detail. The tang 54 of the core catching torsion spring 46 is disposed within lateral opening 56 in the bit shaft 36. As best illustrated by FIGS. 4 and 7, the second spring end 50 of the core catching torsion spring 46 is located closest to the cutting edge 34 of the coring bit 26 and will, therefore, be the first portion of the core catching torsion spring 46 to encounter and frictionally engage the formation 16 during coring. When in a default position, as depicted in FIGS. 4-5, the torsion spring 46 is in a radially contracted position, and there is some space radially between the core catching torsion spring 46 and the inner radial surface of the spring groove 44.

FIGS. 6 and 7 illustrate the effect of bit rotation and sidewall 13 contact on the core catching torsion spring 46. Rotation of the coring bit 26 during coring will be in the direction of arrows 58. As the second spring end 50 contacts the sidewall 13, frictional contact between the second spring end 50 and the sidewall 13 will drive the second spring end 50 radially back toward the first spring end 48 along the body of the core catching torsion spring 46. A point of frictional contact between the second spring end 50 and the core 30 is illustrated at 60 in FIG. 7. This will cause the core catching torsion spring 46 to open and expand radially outwardly into the spring groove 44. As can be seen by a comparison between FIGS. 5 and 6, the inner portions of the core catching torsion spring 46 generally extend radially into the core chamber 42 when the core catching torsion spring 46 is in the radially contracted position while these inner portions lie generally within the spring groove 44 and outside of the core chamber 42 when the core catching torsion spring 46 is in the radially expanded position (FIG. 6).

It is noted that methods of operation in accordance with the present invention provide a core catcher apparatus with a long life span by reducing wear upon the core catching torsion spring 46 by the core 30. Once the core catching torsion spring 46 has been radially expanded as described previously, it will reside largely within the spring groove 44 as coring continues and the core 30 further enters into the core chamber 42. As a result, there will be a significant reduction, or even elimination, of friction forces and normal forces between the radial exterior of the core 30 and the radially interior surface of the core catching torsion spring 46 during coring (see FIG. 2).

When rotation of the core catching torsion spring 46 is stopped, the shape-memory of the core catching torsion spring 46 causes the core catching torsion spring 46 to return to the radially contracted position of FIGS. 4-5. The core catching torsion spring 46 will grip a core sample, such as core sample 30 (FIG. 4), when in the radially contracted position. The ability to radially expand the core catching torsion spring 46 during coring will help the coring bit accept a core 30 of larger diameter while securely gripping the same core once coring ends.

It is further noted that the invention provides an improved technique for detaching and removing the core 30 from the formation 16 at the once the circular opening 28 has been cut and rotation of the coring bit 26 has ended. At this time, the core catching torsion spring 46 will radially contract to capture the core 30, as depicted in FIG. 4. To detach the core 30 from the formation 16, the coring tool 22 is moved within the wellbore 10 to cause the coring bit 26 to apply a lateral or angular force upon the core 30. It should be understood that, at the time the coring tool 22 is moved, the core catching torsion spring 46 will apply a tensile force upon the core 30 to assist in its detachment and removal from the formation 16. The inventors believe that this technique is particularly effective in instances where the formation 16 has low unconfined compressive rock strength.

Those of skill in the art will recognize that numerous modifications and changes may be made to the exemplary designs and embodiments described herein and that the invention is limited only by the claims that follow and any equivalents thereof.

What is claimed is:

1. A rotary coring bit for use in rotary sidewall coring in a wellbore, the coring bit comprising:

a rotary coring bit body forming a core chamber within;

a core catching torsion spring disposed within the core chamber, the core catching torsion spring being moveable between a radially expanded position and a radially contracted position which is capable of gripping a core sample within the core chamber, wherein the core catching torsion spring is oriented such that it winds around a longitudinal axis of the core chamber; and wherein the core catching torsion spring is moved from the radially contracted position to the radially expanded position by frictional contact between the core catching torsion spring and a sidewall of the wellbore as the rotary bit body is rotated.

2. The rotary coring bit of claim 1 wherein:

the core catching torsion spring includes a first spring end and a second spring end; and the first spring end is secured to the rotary bit body.

3. The rotary coring bit of claim 2 wherein:

the first spring end includes a tang which is angled with respect to an axis of the core catching torsion spring; and the tang is disposed within a lateral opening within the rotary bit body to secure the first spring end to the rotary bit body.

4. The rotary coring bit of claim 1 wherein the core catching torsion spring has from two to fifteen winds.

5. The rotary coring bit of claim 1 wherein the rotary coring bit body presents a cutting edge suitable for cutting rock.

6. The rotary coring bit of claim 1 further comprising:

a radially enlarged spring groove formed within the core chamber; and wherein the core catching torsion spring resides at least partially within the spring groove when it is radially expanded, thereby reducing or eliminating frictional forces between the core catching torsion spring and the core sample during coring.

7. The rotary coring bit of claim 1 wherein the core catching torsion spring in the radially contracted position gripping a core sample will apply a tensile force to the core sample during movement of the rotary coring bit to assist detachment of the core sample from a formation.

8. A rotary coring bit for use in rotary sidewall coring in a wellbore, the coring bit comprising:

a rotary coring bit body which presents a cutting edge suitable for cutting rock as the rotary coring bit body is rotated, the rotary coring bit body further forming a core chamber within;

a core catching torsion spring disposed within the core chamber, the core catching torsion spring being moveable between a radially expanded position and a radially contracted position which is capable of gripping a core sample within the core chamber, wherein the core catching torsion spring is oriented such that it winds around a longitudinal axis of the core chamber; and wherein the core catching torsion spring is moved from the radially contracted position to the radially expanded position by frictional contact between the core catching torsion spring and a sidewall of the wellbore as the rotary bit body is rotated.

9. The rotary coring bit of claim 8 wherein:

the core catching torsion spring includes a first spring end and a second spring end; and the first spring end is secured to the rotary bit body.

10. The rotary coring bit of claim 9 wherein:

the first spring end includes a tang which is angled with respect to an axis of the core catching torsion spring; and the tang is disposed within a lateral opening within the rotary bit body to secure the first spring end to the rotary bit body.

11. The rotary coring bit of claim 8 wherein the core catching torsion spring has from two to fifteen winds.

12. The rotary coring bit of claim 8 further comprising:

a radially enlarged spring groove formed within the core chamber; and wherein the core catching torsion spring resides at least partially within the spring groove when it is radially expanded, thereby reducing or eliminating frictional forces between the core catching torsion spring and the core sample during coring.

13. The rotary coring bit of claim 8 wherein the core catching torsion spring in the radially contracted position gripping a core sample will apply a tensile force to the core sample during movement of the rotary coring bit to assist detachment of the core sample from a formation.

14. A rotary coring tool comprising:

a rotary engine for rotating a coring bit; a rotary coring bit having:

a rotary coring bit body which presents a cutting edge suitable for cutting rock as the rotary coring bit body is rotated, the rotary coring bit body further forming a core chamber within;

a core catching torsion spring disposed within the core chamber, the core catching torsion spring being moveable between a radially expanded position and a radially contracted position which is capable of gripping a core sample within the core chamber, wherein the core catching torsion spring is oriented such that it winds around a longitudinal axis of the core chamber; and wherein the core catching torsion spring is moved from the radially contracted position to the radially expanded position by frictional contact between the core catching torsion spring and a sidewall of the wellbore as the rotary bit body is rotated.

15. The rotary coring tool of claim 14 wherein:

the core catching torsion spring includes a first spring end and a second spring end; and the first spring end is secured to the rotary bit body.

16. The rotary coring tool of claim 15 wherein:

the first spring end includes a tang which is angled with respect to an axis of the core catching torsion spring; and the tang is disposed within a lateral opening within the rotary bit body to secure the first spring end to the rotary bit body.

17. The rotary coring tool of claim 14 wherein the core catching torsion spring has from two to fifteen winds.

18. The rotary coring tool of claim 14 further comprising:

a radially enlarged spring groove formed within the core chamber; and wherein the core catching torsion spring resides at least partially within the spring groove when it is radially expanded, thereby reducing or eliminating frictional forces between the core catching torsion spring and the core sample during coring.

19. The rotary coring tool of claim 14 wherein the core catching torsion spring in the radially contracted position gripping a core sample will apply a tensile force to the core sample during movement of the rotary coring bit to assist detachment of the core sample from a formation.

* * * * *